United States Patent [19]

Boegli

[11] 3,977,474

[45] Aug. 31, 1976

[54] EMERGENCY RESERVE WATER AND FOAM GENERATING SYSTEM

[76] Inventor: Paul Boegli, 595 E. Valley View Drive, New Holland, Pa. 17557

[22] Filed: Jan. 27, 1975

[21] Appl. No.: 544,509

Related U.S. Application Data

[63] Continuation-in-part of Ser. No. 410,246, Oct. 26, 1973.

[52] U.S. Cl. ..... 169/9; 169/14

[51] Int. Cl.[2] ..... A62C 35/00

[58] Field of Search ..... 137/583, 590; 169/9, 169/14, 15, 16

[56] References Cited

UNITED STATES PATENTS

| | | | |
|---|---|---|---|
| 1,501,956 | 7/1924 | Loepsinger | 169/9 |
| 2,249,095 | 7/1941 | Swift et al. | 169/14 X |
| 3,750,754 | 8/1973 | Stults | 169/9 |
| 3,830,309 | 8/1974 | Ray | 169/9 X |

*Primary Examiner*—John J. Love
*Attorney, Agent, or Firm*—Wigman & Cohen

[57] ABSTRACT

A method and apparatus are disclosed for providing a supply of fresh water during emergency situations when the normal fresh water source is interrupted and for generating a high volume of air-water foam for extinguishing fires. The emergency system is connected to the normal fresh water source at the place of installation and diverts the fresh water through a standby tank to continually replenish the tank with fresh water. In the event of fire, a regulated source of high pressure gas is supplied to the tank to expel the water at high pressure through a high expansion foam generator, the foam outlet of which communicates with the spaces of the building or other installation in which the system is installed. The standby tank of reserve water may be positioned above or below ground level according to alternate embodiments of the invention. Other embodiments are disclosed wherein a separate foam generating installation for extinguishing fires is adapted for use with one or more foam generators. According to a further embodiment of the invention, a compact, self-contained foam generating system is disclosed, several of which may be strategically placed in various locations throughout a building or the like for extinguishing fires in the vicinity.

8 Claims, 5 Drawing Figures

EMERGENCY RESERVE WATER AND FOAM GENERATING SYSTEM

CROSS-REFERENCE TO RELATED APPLICATION

This application is a continuation-in-part of my copending U.S. patent application Ser. No. 410,246, filed Oct. 26, 1973, and entitled EMERGENCY RESERVE WATER SYSTEM.

BACKGROUND OF THE INVENTION

1. Field of the Invention

This invention relates to fluid handling systems, and more particularly to an improved method of and apparatus for supplying an emergency source of fresh water to a location such as a household, factory, hospital, or the like, when the normal water supply is terminated, and for generating a high volume of air-water foam for extinguishing fires at such locations.

2. Description of the Prior Art

During emergency situations, for example, natural disasters such as earthquakes, tornados, floods and man-caused disasters, such as war, pollution and the like, there frequently results an extended interruption of fresh water normally supplied by a city water system. In other situations as, for example, equipment failures and labor disputes, the normal supply of fresh water from a city water system may be terminated, but generally for shorter periods of time. Undoubtedly, still other emergency situations exist which create a need for a temporary supply of fresh water, particularly for hospitals, military installations, air raid shelters, schools, and the like. A sudden termination of the fresh water supply, for even short periods of time, in the latter locations where large numbers of persons are likely to be gathered for extended periods, could prove dangerous to health, or in some cases, even life.

Moreover, the hazard of fire which exists in every such location, whether or not during one of the aforementioned disaster situations, is only partly met by the existing capabilities of local fire departments and integrally installed sprinkler systems. In the case of local fire departments, while their response to an alarm is especially prompt in most instances, there inevitably exists in each occurrence of fire, a significant time lag between the initiation of the alarm and the appearance of fire-fighting equipment at the scene. During such time lag, substantial fire damage occurs which might have been avoided if an integrally installed fire-extinguishing system could have been either automatically or manually actuated. Unfortunately, most of the so-called sprinkler systems of the prior art utilize water as the sole fire extinguishing medium and therefore, unlike a foam extinguishing system, cause considerable water damage to areas which are not directly exposed to or are only slightly exposed to the fire.

In addition, such prior art sprinkler systems are likely to be inoperative during the previously-mentioned periods when the city water system is interrupted. Even if an emergency source of water were available to supply one of the known sprinkler systems, it would necessarily be of rather large volume and therefore uneconomically installed and maintained, particularly in the case of the average homeowner. Furthermore, the pressures at which the normal supply of city water is delivered are generally insufficient without pumping to generate a sufficient volume of foam having a relatively low water content so as to avoid substantial water damage to the spaces into which the foam is introduced.

In view of the foregoing, it should be appreciated that there is a need, heretofore unfulfilled for an emergency water reserve and fire extinguishing system, operable automatically or manually, either remotely or in situ, and which is capable of storing and supplying a standby source of fresh water for emergency situations, and, further, which is capable, without the need for an electrically operated pump, of generating and distributing a large volume of fire-extinguishing air-water foam throughout the location where the system is installed.

To ascertain the state of the art relative to this invention, a search of the pertinent United States Patents was conducted which uncovered the following patents:

| U.S. Pat. No. | Patentee | Issue Year |
|---|---|---|
| 907,504 | Kane | 1908 |
| 912,243 | Hill | 1909 |
| 1,635,745 | Ellis | 1927 |
| 2,227,322 | Scully et al | 1940 |
| 2,939,476 | Absolon | 1960 |
| 3,433,258 | Steele | 1969 |
| 3,500,935 | Wiedorn | 1970 |
| 3,822,217 | Rogers | 1974 |

None of the patents uncovered disclose a method and apparatus for providing an emergency supply of fresh water and for generating a high volume of fire-extinguishing air-water foam. It is recognized that each of the components utilized in the present invention is conventional; nevertheless, the combination of such components in the present system and the method taught herein are neither disclosed nor suggested by the prior art.

SUMMARY OF THE INVENTION

Briefly described, the emergency water reserve and fire extinguishing apparatus according to the present invention is operatively connected to the normal source of fresh water supplied by a city water system through a main conduit. Means are provided for diverting the fresh water supplied from the main conduit to the existing distribution system through a standby tank or reservoir in order to maintain the tank in a substantially full condition and to provide for the continual replenishment of the tank with fresh water of good quality from the main conduit. Means are also included for generating and distributing to desired spaces in the location at which the system is installed a large volume of high air-to-water ratio fire-extinguishing foam, using as the water source the water stored in the standby tank. Thus, should an emergency situation arise in which the normal supply of water is interrupted or becomes contaminated, the reserve system of the present invention is immediately available for everyday consumptive use as well as for fire emergencies. Although electrically-operated pumps may be utilized to provide a better pressure head for supplying the water reserve, such pumps are not essential for system operability in either the everyday consumption mode or the fire-fighting mode.

According to the apparatus aspects of the invention, in one embodiment the standby tank is positioned above ground. Therefore, the system is functional for everyday consumption by gravity as well as by a pressure head supplied by a regulated high pressure gas source. The standby tank includes inlet and outlet conduits terminating internally of the tank; the outlet conduit terminating adjacent the uppermost portion of the tank to continually maintain the tank in a substantially filled condition during non-emergency periods; and the inlet conduit terminating adjacent the lowermost portion of the tank to insure substantially complete removal of the water content of the tank during emergency periods. The term "inlet" as used throughout the specification and claims herein refers to the direction of water flow into the tank during non-emergency use. During such non-emergency or normal use, fresh water supplied from the main conduit of the city water system flows through the standby tank from inlet to outlet, while during emergency or fire-extinguishing use, the water reserve in the tank flows out through the tank inlet.

To prevent loss of water from the standby tank to the main conduit or contamination of the fresh water in the tank, an automatically or manually operated shut off valve is provided in the supply conduit to prevent flow between the standby tank and main conduit. When the pressure in the supply conduit falls below standby tank pressure or below a predetermined magnitude, a pressure-responsive switch activates an alarm and either operates an automatic shut off valve or warns that a manual shut off valve should be operated. Conventional valves, including check valves and pneumatic or spring-operated valves, which close at a predetermined pressure, may be employed where desired. The standby tank is provided with a vent communicating with the uppermost portion of the tank to prevent the creation of a vacuum within the tank when draining the tank by gravity during emergency situations.

The foam generating means may be one of several well known types, for example, the water-powered high-expansion foam generator disclosed in U.S. Pat. No. 3,500,935, the description of which is incorporated herein by reference. Such a foam generator is capable of producing a foam having between approximately a 700:1 and 100:1 foam/water volume ratio. Any other suitable foam generator utilizing a mixture of air, water and foam liquid could be adapted for use in the emergency system described herein, including the foam forming device disclosed in U.S. Pat. No. 3,822,217, the description of which is also incorporated herein by reference. A capacity of up to 3000 CFM and a foam/water volume ratio of up to 1000:1 is possible with known commercially available electrically powered high expansion foam generators.

By suitable piping, one or more of the aforementioned foam generators may be connected to the standby tank adjacent thereto or remotely in a preselected location or locations. Preferably, for a household, a single generator is provided which is connected via existing home heating/cooling ducting or through ducting installed concurrently with the emergency system to all the space in the home. The register outlets in each space are preferably of open construction to permit relatively unimpeded flow of foam into the space. A source of compressed air or other gas, such as nitrogen, at a pressure of, for example, 2000 psi is connected through a pressure regulator variable between about 500 psig and 50 psig, and set at about 300 psig, to the uppermost portion of the standby tank for exerting a sufficient pressure head on the water in the tank for operating the foam generator. As previously mentioned, the regulator may also be regulated to a pressure lower than 300 psig as necessary and utilized to supply a pressure head to the emergency water reserve system in the everyday consumption mode. The latter capability is particularly advantageous when the standby tank is unobtrusively buried below ground as is also contemplated by the present invention.

If the standby tank is located below ground, an electrically operated pump may be included in the system in order to conserve the supply of high pressure gas, but it should be recognized that the system is operable without such pump in the event the interruption of fresh water supply is accompanied by loss of electrical power, as is commonly the case in natural disaster situations. Obviously, during normal use the water pressure in the city water system is generally sufficient to convey fresh water through the below ground tank into the user's distribution system.

In those instances where a source of fresh water is otherwise available for emergencies or is not desired, alternate embodiments of the invention, as described herein, include only a foam generating system for extinguishing fires and which is connected either with a continuous source of water or operable independently thereof. Such foam generating system may be compactly arranged within a housing or cabinet as a substantially portable, self-contained fire fighting apparatus. Several of these installations may be strategically situated throughout a building, such as on the several floors of a high-rise apartment complex or the like, for extinguishing fires in the various apartments or other areas of a particular floor. An important feature of the disclosed fire fighting apparatus is that it enables operation of the foam generator even in the absence of a constant supply of water under pressure from, for example, a fire main.

According to the method aspects of the present invention, a method of supplying a source of fresh water is accomplished by diverting the flow conveyed from the normal fresh water source through a standby tank and storing a continually replenished predetermined quantity of such fresh water in the tank. One aspect of the inventive method permits utilization of the water supply in emergency situations for everyday consumption. Another important aspect of the method permits the generation of a large volume of high air-to-water ratio foam for extinguishing fires in any fire emergency situation, particularly when city water is interrupted.

An important feature of the emergency reserve water system of the present invention is the continual replenishment of the water in the standby tank to maintain a "fresh" source of emergency water. "Fresh" is to be understood to mean that the water in the tank diverted from the normal source of supply is comparable in quality to such normal source since it is replenished on a continuous basis. This contrasts with the type of system as disclosed in FIG. 5 of the earlier-mentioned Steele patent wherein water is deposited in an underground vessel and remains in the vessel for a prolonged period of time before it is consumed. It should be apparent that the Steele system is static in nature, yielding water which is flat and distasteful by virtue of its lengthy storage time during which the water picks up metallic as well as other impurities from the tank. The present invention obviates the foregoing disadvantage by providing a dynamic flow system which yields an emergency water reserve which is of good quality and is fresh. It is also contemplated within the scope of the present invention that the numerous tank installations presently existing throughout the country might be modified or adapted as a component of the apparatus of the present invention and utilized in the practice of the method disclosed herein.

Other objects, advantages and features of the invention relate to structural details and novel combinations and arrangements thereof which will become hereinafter apparent when considered in conjunction with the accompanying drawings wherein:

DESCRIPTION OF A PREFERRED EMBODIMENT

Figure 1:
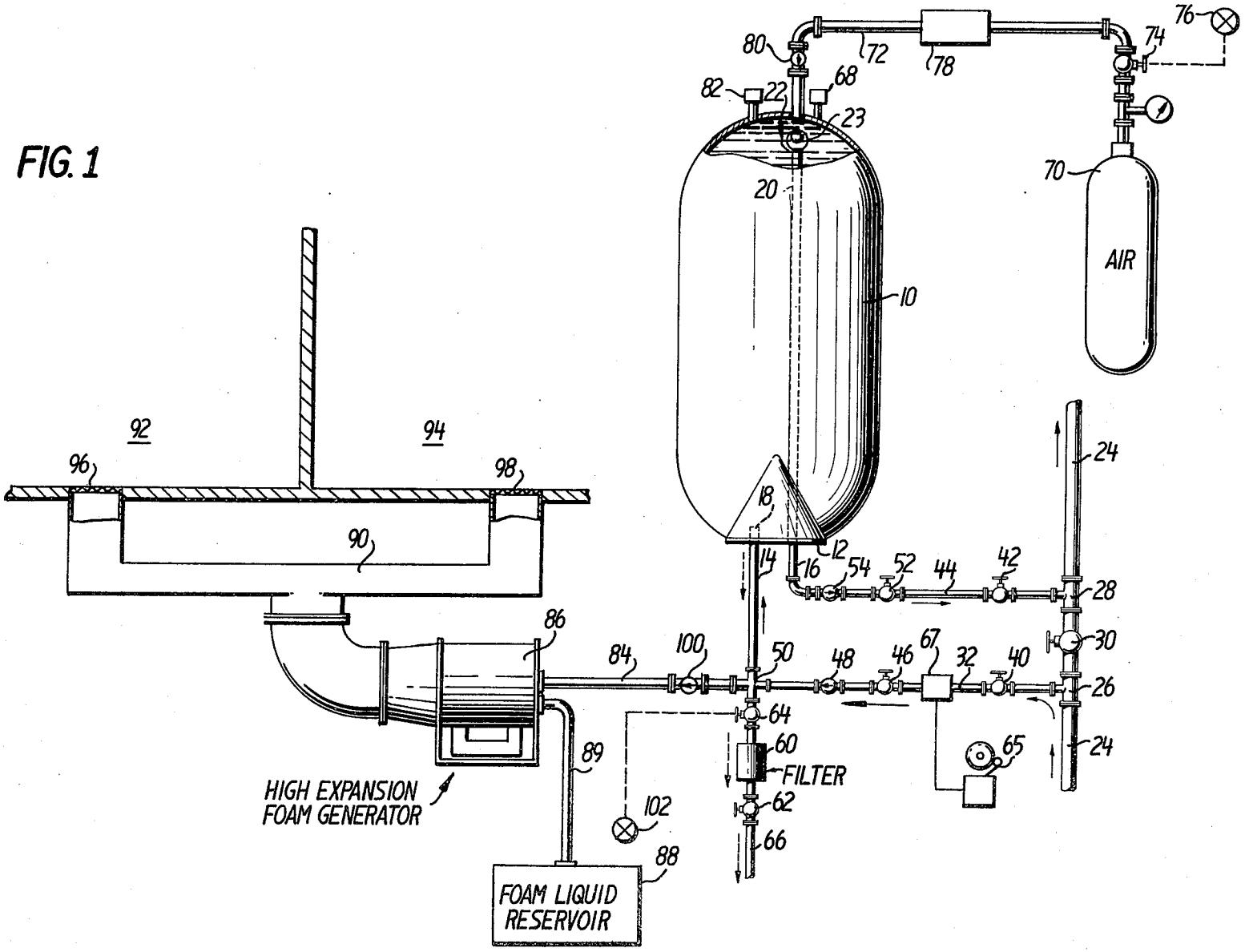
FIG. 1 is a pictorial representation, partly in section, showing a preferred embodiment of a system for providing an emergency supply of fresh water and for generating a fire-extinguishing foam wherein the tank is positioned above ground.

Referring now to the drawings and in particular to FIG. 1, there is illustrated a closed standby tank 10 of generally cylindrical configuration. The standby tank 10 may be conventionally formed of steel or other suitable materials, depending on tank size, internal pressures anticipated, intended location, and other similar factors. At those portions of the system which may be subjected to pressures higher than the normal operating range of the pressures in a city water system, i.e., up to 500 psig, suitable conduits and valves capable of withstanding such pressures should be utilized.

Located at the bottom portion 12 of the tank 10 are spaced conduits 14, 16. Conduit 14 preferably extends into the tank and terminates in an open-ended condition, as shown in phantom at 18, adjacent the lowermost portion of the tank. If desired, conduit 14 could end at the inner wall of tank 10. However, sediment and other such impurities which normally settle at the tank bottom would escape. Conduit 16 extends into the tank for a distance substantially the length of the tank. The portion within the tank is shown in phantom as standpipe 20. Standpipe 20 is open-ended and terminates at 22 just below the uppermost portion of the tank. A check valve 23, configured as a caged floating ball, is installed at the terminus of standpipe 20. Thus, as will be described in greater detail hereinafter, in normal non-emergency use water entering from inlet conduit 14 rises, causing the caged-ball of check valve 23 to float, and then exits via standpipe 20 and outlet conduit 16, keeping the tank in a substantially filled condition, as shown, at all times.

The present system includes means for diverting fresh water from the normal city water system which supplies conduit 24. As illustrated, tee connections 26, 28 are installed in conduit 24 with shutoff valve 30 therebetween. Thus, water from conduit 24 passes to inlet conduit 14 and the tank 10, as shown by the solid arrows, via conduit 32. Shutoff valve 30 is normally operated in closed or partially closed condition. When the standby system of the present invention is shut down for repairs or the like, valve 30 is opened. At that time, shutoff valves 40, 42 located in conduits 32, 44, respectively, may be closed. In non-emergency use, valves 40, 42 are normally open to permit the diversion of water from conduit 24 through conduit 32 to the tank 10 and back to conduit 24 through conduit 44 located upstream of tee connection 28.

Downstream of valve 40, there is provided, in series relationship, a second shutoff valve 46, a check valve 48, and a four-way fitting 50 which communicates with tank inlet conduit 14. Upstream of valve 42, there is provided, also in series relationship, a shutoff valve 52 and a check valve 54. Valves 52 and 54 are identical to valves 46 and 48, respectively, except of course, check valve 54 is positioned to permit flow in the opposite direction to water flowing through check valve 48.

As shown in FIG. 1, there is also provided a filter 60 positioned in conduit 66 of the emergency reserve piping system downstream of the four-way fitting 50. A pair of shutoff valves 62, 64 connected to conduit 66 permits removal of the filter for cleaning or replacement purposes. Valve 64 is also provided with means for operating the valve from a remote location which may be a manually operated handwheel 102. The filter 60 is preferably filled with charcoal or other suitable sorbent material.

In normal use during non-emergency periods, water is diverted from conduit 24 and enters tank 10 via valves 40, 46 and 48. The water fills the tank, floats the ball of check valve 23, exits through standpipe 20 and is returned to conduit 24 upstream of valve 30 via valves 54, 52 and 42. Valves 62, 64 are normally closed. The water re-enters conduit 24 and is conveyed to conventional outlets, e.g., faucets and the like, where normal use can occur.

In the event of a catastrophe where the water pressure in main conduit 24 falls below a predetermined level, an alarm means 65, which may be battery powered, is actuated by a pressure switch 67 located in conduit 32 or, alternatively in conduit 24 upstream of conduit 32. At that time, valves 40, 42 can be manually shut off and valves 62, 64 opened to permit water from the tank 10 to pass into conduits 14 and 66 and then outwardly to an emergency supply piping system reserved for critical uses. The direction of water flowing into the emergency conduit is shown by the dotted arrows. Check valve 48 prevents inadvertent loss of water from the tank 10 to the supply conduit even where valve 40 is inadvertently left open. In lieu of check valve 48 and pressure switch 67, a pressure actuated device may be provided which automatically shuts off conduit 32 when the inlet pressure falls below a predetermined value, i.e., 20 psig. The pressure activated device may also be arranged to energize alarm means 65. Optionally, a monitoring means (not shown) may be provided in conduit 66 to determine whether the water entering the emergency reserve water system is safe to drink.

As the level of water in the tank 10 drops during gravity feeding of the emergency reserve water system, a vacuum would be created in the resulting free volume of the tank. To counter this effect, vent means 68 is provided to allow air from the atmosphere to enter the tank and to equalize the pressure. The vent means 68 can be a vacuum breaker or any other pressure response device known in the art and suitable for this purpose.

Proceeding now with the description of the fire emergency foam generating system, a source of high pressure gas is provided by a tank 70 which is connected via conduit 72 in communication with the interior of the uppermost portion of standby tank 10. Conduit 72 is preferably aligned with the axis of standpipe 20 and caged-ball check valve 23. High pressure gas tank 70 is also provided with a shutoff valve 74 which is normally closed and which is also operable remotely by a hand wheel 76 positioned, for example, externally of the building, house or other location, where the present system is installed. The tank 70 contains a volume of gas at a sufficient pressure to expel the contents of the standby tank at a pressure of approximately 300 psig. A conventional pressure regulator 78 is provided for reducing and regulating the gas pressure supplied to the tank to a predetermined pressure up to about 500 psig and preferably between 50 and 300 psig. A check valve 80 is connected in conduit 72 and arranged as shown to prevent the flow of water into conduit 72. A safety valve 82 is connected to the uppermost portion of the standby tank 10 to relieve the pressure therein should the design pressure of the tank be exceeded.

A conduit 84 connects the four-way fitting 50 to the water powered high expansion foam generator 86, which may be of the type disclosed in U.S. Pat. No. 3,500,935, previously mentioned. A supply of commercially available foam liquid adapted for use with the foam generator 86 is provided in a reservoir 88 and is operatively connected via conduit 89 to foam generator 86. The outlet of foam generator 86 is connected through suitable ducting 90 to the various spaces 92, 94 of the house, building or the like, with which the system is associated. The ducting utilized is preferably the existing heating/cooling ducting normally installed in habitable buildings. When such ducting is not provided or is not adaptable for transmitting foam, separate ducting may be provided. Outlet registers 96, 98 are preferably constructed with relatively open configuration so as not to impede the rapid introduction of foam into the spaces 92, 94. In larger buildings, such as hospitals, apartments, and factories, it is contemplated that several foam generators may be placed in preselected locations for generating effective amounts of fire-extinguishing foam in each such location. Where several foam generators are used in preselected locations, it is contemplated by the present invention that the ducting 90 may be eliminated since each foam generator and its associated foam liquid reservoir could be connected to directly introduce foam into a room or space at its location. With such arrangement it is only necessary to supply water under 300 psig pressure from the tank 10 to each of the foam generators since foam ducting, air piping and electrical circuits are not required for operation of the generator.

A check valve 100 is installed in conduit 84 and is of a type which permits flow only in one direction when a predetermined pressure has been exceeded at the inlet thereof. Check valve 100 is preferably set to open at a suitable pressure in excess of the maximum pressure of the city water supply. During non-emergency conditions and during use of the emergency water reserve system, check valve 100 will, therefore, remain closed.

In the event of a fire during non-emergency periods, that is, when the system is being normally supplied by the city water supply, upon opening valve 74, either locally or remotely, the foam generating system will be placed in operation. Regulator 78 can be set to provide 300 psig gas to standby tank 10 via conduit 72 and check valve 80. When the high pressure gas flow from conduit 72 enters tank 10, caged-ball valve 23 will operate to close standpipe 20, thereby preventing high pressures in conduits 16, 44 and the normal water distribution system. Valve 64 is in its normally closed position so that the emergency water reserve system is not subjected to high pressures and check valve 48 blocks the back pressure into conduits 32, 34. When the pressure at the inlet of check valve 100 exceeds the predetermined opening pressure thereof, the valve 100 will open permitting water flow into foam generator 86, which generates a large volume of high air-to-water ratio foam in conjunction with the liquid in foam liquid reservoir 88. The foam thus generated is introduced into the spaces 92, 94 via ducting 90 and outlets 96, 98 to substantially fill the space, thereby smothering any fire present. The low water content of the foam advantageously minimizes water damage in the foam-filled space. If a fire occurs during an emergency situation in which city water has been interrupted, valve 64 will normally be open and must be closed locally or remotely by a hand wheel 102 provided for that purpose prior to opening valve 74.

The high pressure gas tank 70 also permits the establishment of a pressure head on the standby tank 10 without the need for a pump when it is desired to withdraw water from the tank 10 at a point higher than the water level in the tank during an interruption of the normal city water system. For this purpose, the pressure regulator 78 is adjusted to supply gas to the tank 10 at a low pressure of about 50 psig and valve 74 is opened to thereby supply fresh water at conduit 66 at the lower pressure. In a fire emergency, the pressure regulator must, of course, be adjusted to supply tank 10 with gas at about 300 psig.

If desired, the termination 18 of conduit 14 may extend upwardly into tank 10 for some distance in order to conserve at least a portion of the fresh water in the tank for an emergency water reserve. Other modifications and variations of the apparatus disclosed in FIG. 1 are possible, for example, heat sensitive means arranged in spaces 92, 94 may be operatively connected in a well known manner to automatically operate any of the illustrated valves, in particular valves 64 and 74. In addition, conduit 84 may be arranged to supply a manifold connected to a plurality of separate foam generators for introducing foam into various building spaces or to a portable foam conduit or flexible hose for extinguishing external fires.

Figure 2:
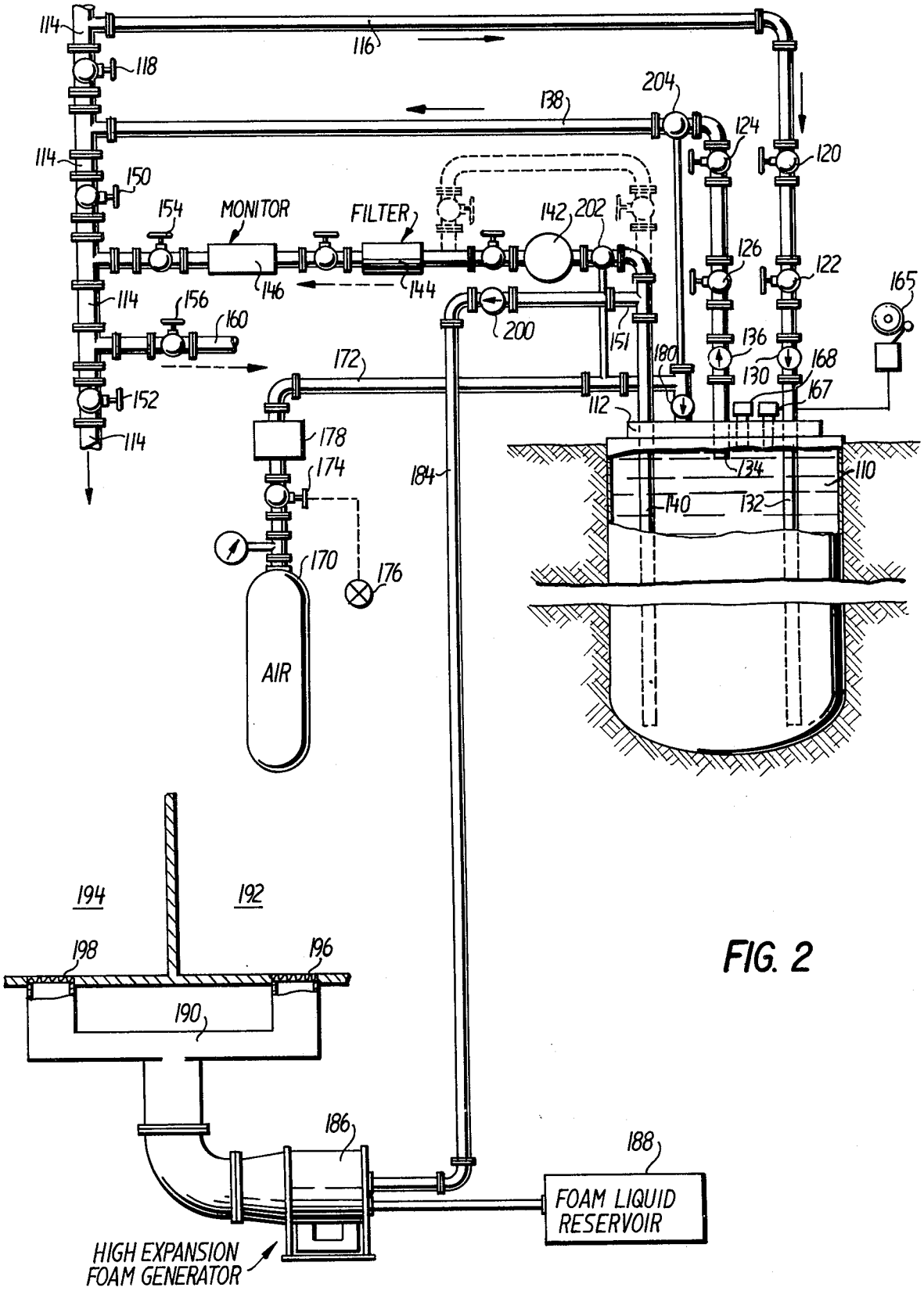
FIG. 2 illustrates an alternative embodiment, partly in section, of the emergency water reserve and foam generating system of the present invention wherein the water reserve tank is located below ground.

Referring now to FIG. 2 of the drawings which schematically illustrates an additional embodiment for carrying out the method according to the present invention, one difference between the system represented in FIG. 2 and the system depicted in FIG. 1 is the manner in which the reserve tank is installed. In FIG. 1, the tank 10 is designed for above ground use to enable the utilization of gravity for providing the energy to move the water from the tank to its destination in emergencies without the need for auxiliary pumps or the like.

In FIG. 2, the reserve tank is designed to be unobtrusively placed below ground, e.g., buried, and hence the piping system associated therewith could include an auxiliary electrically-operated pump. In lieu of a pump, however, the high pressure gas tank 170 may be operated as previously described to establish a pressure head in below ground reserve tank 110.

The reserve tank 110 includes a removable cover 112 sealable therewith through which pass the various conduits for supplying and removing the water from the tank 110. City water enters the system by way of conduit 114 and is diverted into conduit 116 by virtue of valve 118 being closed and valves 120, 122, 124, 126 being open. Water passes through check valve 130 and enters conduit 132 which extends the length of the tank and is open-ended. The outlet conduit 134 is positioned in the cover 112 or can extend a short distance into the tank 110. After the tank is substantially full, the water enters conduit 134 and is returned to supply conduit 114 by passing through check valve 136, valves 126, 124 and conduit 138. The above description applies for non-emergency use of the tank 110. As will be appreciated, this procedure insures a tank filled with fresh water at all times.

In emergency situations when the normal water supply is interrupted, valves 120, 124 are closed and water in the tank 110 is drawn up by pump 142 through conduit 140, which extends the length of the tank. The water is filtered at filter 144, monitored by a geiger counter 146 or equivalent device, and is conveyed into conduit 114. Valves 150, 152 are closed and valves 154, 156 are opened. The filtered water enters conduit 160 where it is distributed throughout the emergency water reserve piping system.

It is also contemplated that the emergency water reserve system can be placed into normal service so as to permit utilization of the filtration and monitoring means in day-to-day use. This is easily effected by bypassing the pump 142, utilizing the piping shown in phantom, and merely closing off valves 124, 150.

The arrangement of the foam generating system of FIG. 2 is similar to that of FIG. 1. Tank 170 supplies high pressure gas to tank 110 through conduit 172 via shut-off valve 174, which is remotely operable by hand wheel 176, thence through the pressure regulator 178, and check valve 180. Foam generator 186 is supplied water from tee connection 151 via conduit 184 when check valve 200 opens at a predetermined pressure in excess of normal water supply pressure. The generated foam is introduced into spaces 192, 194 via outlets 196, 198 from ducting 190. To prevent pressurization of either distribution conduit 114 and the emergency water reserve piping system in the event of fire, pneumatically operated valves 202, 204 are in communication with conduit 172 and close automatically upon operation of valve 174 to supply gas pressure to tank 110. Check valve 130 prevents back flow into conduit 116 and the normal city water supply system. Vent means 168 is provided in tank 110 as well as pressure sensing means 167 to actuate alarm means 165 when the city water pressure falls below a predetermined magnitude.

Figure 3:
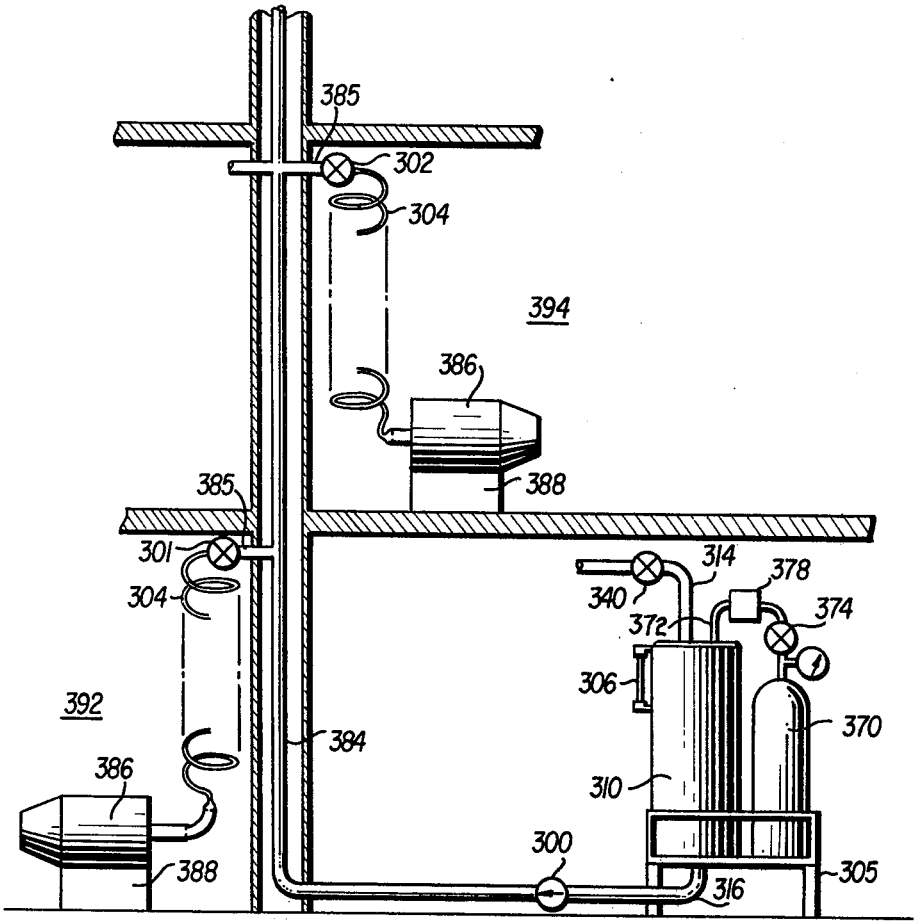
FIG. 3 is a diagrammatic view of an embodiment of the foam generating apparatus of the invention showing a plurality of foam generators positioned in various spaces of a building.

FIG. 3 schematically illustrates an arrangement of a foam generating fire extinguishing apparatus without the emergency reserve water supply feature. A closed water tank 310 is supplied with water from any convenient source via valve 340 and inlet conduit 314 which communicates with the interior uppermost portion of the tank 310. At the bottom of tank 310 an outlet conduit 316 connects the interior of the tank via check valve 300 with a distribution conduit 384 extending vertically within a wall of a building or the like in which the system is installed. Check valve 300 is preferably of a type which permits flow in one direction when a predetermined pressure has been reached at the inlet thereof.

High pressure gas tank 370 is connected via conduit 372 also to the interior uppermost portion of tank 310 and is provided with a conventional pressure regulator 378 for reducing and regulating the air supplied to the water tank 310 as previously described in connection with FIGS. 1 and 2. Shut-off valve 374 is normally closed and when opened introduces a gas such as air or nitrogen at a regulated pressure of, for example, 300 psig into water tank 310. When the pressure in tank 310 and conduit 316 reaches the predetermined opening pressure of check valve 300, water flows into distribution conduit 384 and thence to conduits 385 extending through the vertical wall into the building spaces 392, 394. Each conduit 385 is connected via valves 301, 302 to a coiled water supply line 304 and portable foam generator 386 which includes an integral reservoir 388 of foam liquid.

To combat a fire, for example, in space 394, valves 374 and 302 are opened to thereby supply water to foam generator 386. The coiled water supply line 304 is of sufficient length and flexibility to permit effective positioning of the foam generator in proximity to the fire.

The water tank 310 and gas tank 370 may be conveniently arranged in a frame 305, either vertically as shown or by suitable arrangement of piping in a horizontally disposed position. Preferably, water tank 310 is provided with a water level gauge 306 for indicating the level of water in the tank. In those installations wherein it is not feasible to provide a distribution conduit 384 in the building wall, such as, for example, when installing the system in a previously constructed building, the conduits 384, 385 may be replaced by flexible high pressure tubing. The foam generating system of FIG. 3 advantageously permits activation of a single foam generator located in close proximity to the fire. This system is particularly adapted for use in buildings having a large number of spaces such as, for example, high-rise apartment complexes and the like.

Figure 4:
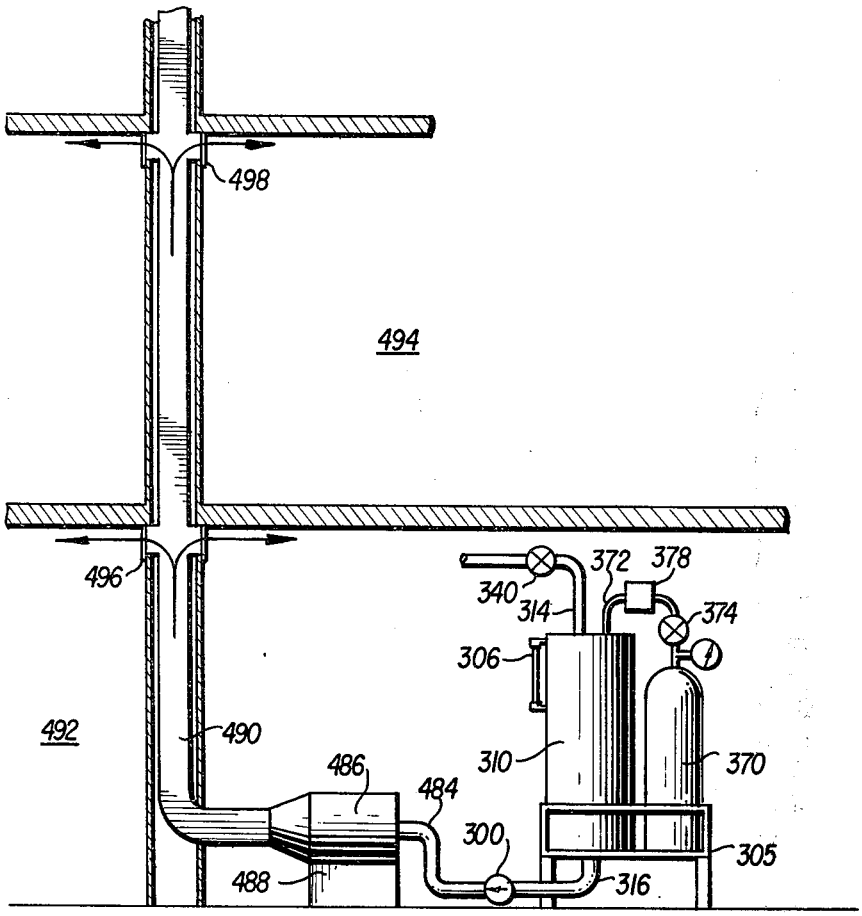
FIG. 4 is a diagrammatic view of another embodiment of the foam generating apparatus wherein a single foam generator supplies a plurality of spaces in a building.

In FIG. 4 there is illustrated another embodiment of the foam generating apparatus of the invention without the emergency reserve water supply feature. In this embodiment, the outlet conduit 316 from water tank 310 is connected via check valve 300 and conduit 484 to a single foam generator 486 which includes integral foam liquid reservoir 488. A manifold duct 490 which may be formed of 4 inch diameter flexible plastic tubing or similar material is connected to the foam outlet of generator 486 and extends vertically through a building wall as shown. The manifold duct 490 communicates with the spaces or rooms 492, 494, for example, through foam outlets 496, 498 which open into an upper portion of a respective space or room. This installation would be suitable for use in, for example, homes or small apartment buildings.

Figure 5:
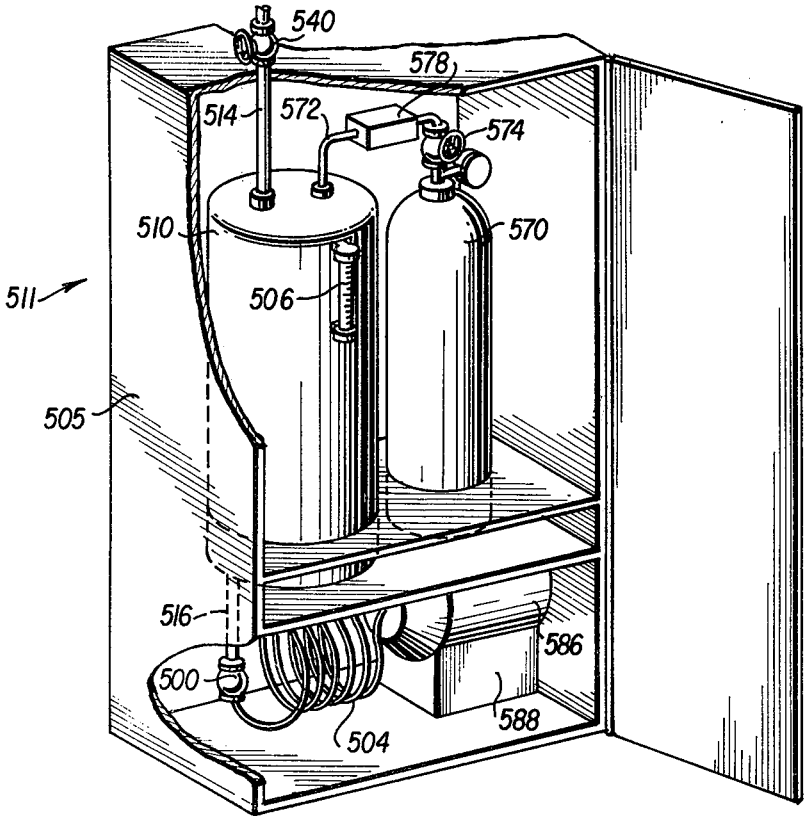
FIG. 5 is a fragmentary perspective view of a portable foam generating apparatus according to the invention.

FIG. 5 shows in perspective a self-contained foam generating apparatus for extinguishing fires and designated generally by reference numeral 511. A water tank 510 and high pressure gas tank 570 are suitably mounted in side-by-side relation within a cabinet 505. The water tank 510 is provided with inlet conduit 514 and valve 540 for introducing water into the tank from any convenient source of supply, such as, for example, a conventional hose. High pressure gas tank 570 is connected via conduit 572 to an uppermost portion of the interior of water tank 510. Valve 574 and pressure regulator 578 are connected in conduit 572 for introducing a regulated pressure into water tank 510 as described in connection with previous embodiments of the invention. A foam generator 586 having an integral supply of foam liquid in reservoir 588 is positioned in the lower portion of cabinet 505 and is connected to water tank 510 through a flexible coiled water line 504, check valve 500 and outlet conduit 516. One or more of these foam generating installations may be strategically located throughout a building in a manner similar to conventional wall mounted fire extinguishers. The foam generating system is readily placed in operation by opening valve 574 which introduces a high pressure gas into water tank 510 to expel the water therefrom through conduit 516, check valve 500, water line 504 and into foam generator 586 which may be of the water-powered type disclosed in U.S. Pat. No. 3,500,935 discussed hereinabove.

Many other modifications, variations and arrangements of the present invention are possible in light of the above teachings and within the purview of the appended claims without departing from the spirit and intended scope of the invention.

I claim:

1. A water reserve system for supplying fresh water for emergency use and for generating a fire-extinguishing foam comprising:

a supply conduit adapted to be connected to a source of fresh water;

a standby tank of predetermined volume;

inlet and outlet means connected to said tank for introducing fresh water into said tank and for continually replenishing the fresh water in said tank, said inlet and outlet means being arranged to maintain said tank in a substantially full condition during normal non-emergency use;

means connected to said tank and said supply conduit for diverting fresh water from said supply conduit into said tank and back to said supply conduit;

means operatively connected to said tank for generating a volume of air-water foam; and means connected to said foam generating means for distributing said air-water foam to a remote location for extinguishing a fire at said location.

2. The system as defined in claim 1 wherein said inlet means includes an inlet conduit having an open end positioned in the lowermost portion of said tank to insure substantially complete removal of the water content thereof during emergency use and wherein said outlet means includes an outlet conduit having an open end positioned in the uppermost portion of said tank to insure a substantially full tank for emergency use.

3. The system as defined in claim 1 including a high pressure gas source means connected to the uppermost portion of said tank for expelling the water in said tank through said foam generating means.

4. The system as defined in claim 2 including a caged ball check valve located at the open end of said outlet conduit for closing the open end of said conduit.

5. The system as defined in claim 3 including means for regulating the high pressure gas supplied to said tank from said gas source means and wherein said foam generating means includes a foam generator operatively connected to said tank and to a source of foam liquid, said foam generator having a foam outlet, air inlet means, and means for mixing air, water and foam liquid whereby a large volume of foam having a high air-to-water ratio is produced.

6. The system as defined in claim 3 including a check valve installed in the operative connection between said foam generating means and said tank, said check valve being arranged to admit flow to said foam generating means when the pressure in said tank reaches a predetermined magnitude.

7. The system as defined in claim 3 including means for remotely operating said gas source means to introduce high pressure gas into said tank.

8. A water reserve system for supplying fresh water for emergency use and for providing a fire-extinguishing fluid comprising:

a supply conduit adapted to be connected to a source of fresh water;

a standby tank of predetermined volume;

inlet and outlet means connected to said tank for introducing fresh water into said tank and for continually replenishing the fresh water in said tank, said inlet and outlet means being arranged to maintain said tank in a substantially full condition during normal non-emergency use, said inlet and outlet means including an inlet conduit having an open end positioned in the lowermost portion of said tank to insure substantially complete removal of the water content thereof during emergency use and an outlet conduit having an open end positioned in the uppermost portion of said tank to insure a substantially full tank for emergency use;

means connected to said tank for diverting fresh water from said supply conduit into said tank and back to said supply conduit;

means operatively connected to said tank for generating a fire extinguishing fluid, said generating means including a high pressure gas source means connected to the uppermost portion of said tank for expelling the water in said tank and means for regulating the high pressure gas supplied to said tank from said gas source means; and means connected to said tank for distributing the fire extinguishing fluid generated by said generating means to a remote location for extinguishing a fire at the remote location.

* * * * *